United States Patent [19]

Bognar et al.

[11] Patent Number: 4,964,337

[45] Date of Patent: Oct. 23, 1990

[54] INK ROLLER

[75] Inventors: Daniel Bognar, Wiesbaden; Hans-Jörg Laubscher, Frankenthal, both of Fed. Rep. of Germany

[73] Assignee: Miller-Johannisberg Druckmaschinen GmbH, Wiesbaden, Fed. Rep. of Germany

[21] Appl. No.: 736,360

[22] Filed: May 21, 1985

[51] Int. Cl.[5] ..... B41F 31/14; B41F 31/34

[52] U.S. Cl. ..... 101/350; 101/DIG. 32

[58] Field of Search ..... 101/DIG. 6, DIG. 28, 101/351, 352, 350, 348, 349, 205, 206, 207, 208, 209, 363, DIG. 22, DIG. 32

[56] References Cited

U.S. PATENT DOCUMENTS 1,354,639 10/1920 Wood ..... 101/350
2,467,199 4/1949 Faeber ..... 101/348
4,129,077 12/1978 Fischer ..... 101/350
4,361,090 11/1982 Klingler et al. ..... 101/350 X

*Primary Examiner*—J. Reed Fisher

[57] ABSTRACT

An inker and form roller unit for a printing press includes a continuously rotating fountain roller for carrying ink from a reservoir. A combi-roller is in constant contact with a distribution roller to deliver ink to rollers of the printing press. The combi-roller and distribution roller are supported by a swivel lever that can pivot about the rotational axis of the distribution roller. The swivel lever carries a cam roller for contact with a control body having two or more sections, one of which is for continuous film inking and the other section for intermittent inking. The combi-roller is positioned relative to the fountain roller by the control body so as to form either a continuous fluid transfer gap or an intermittent fluid transfer gap.

12 Claims, 4 Drawing Sheets

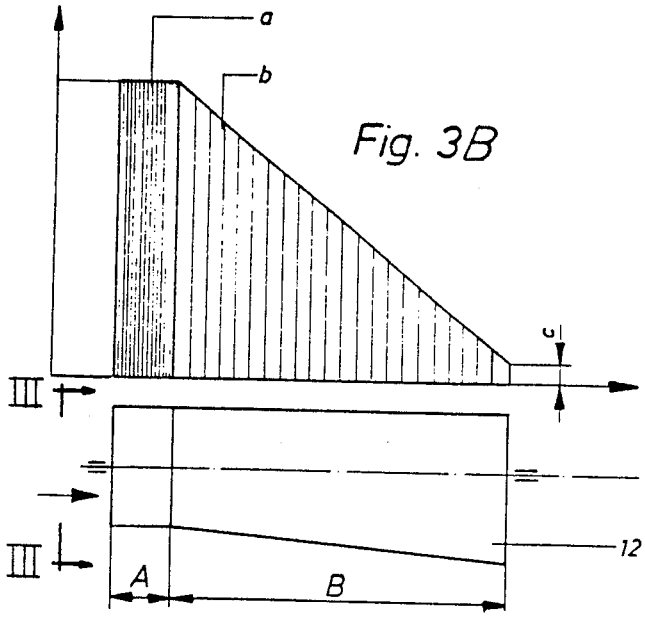
Fig. 3B
Fig. 3A
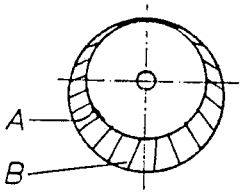
Fig. 3
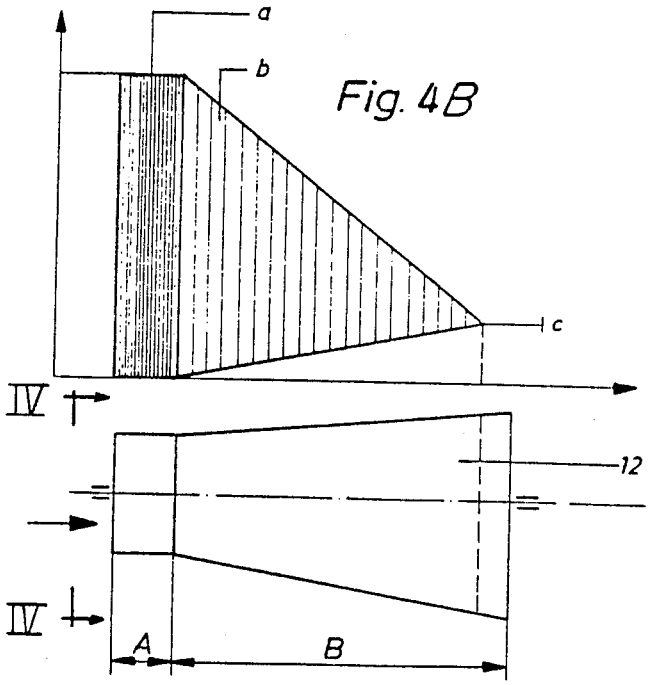
Fig. 4B
Fig. 4A
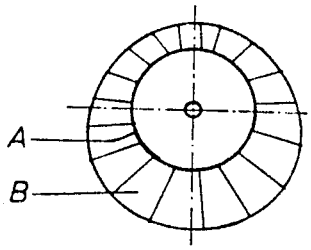
Fig. 4

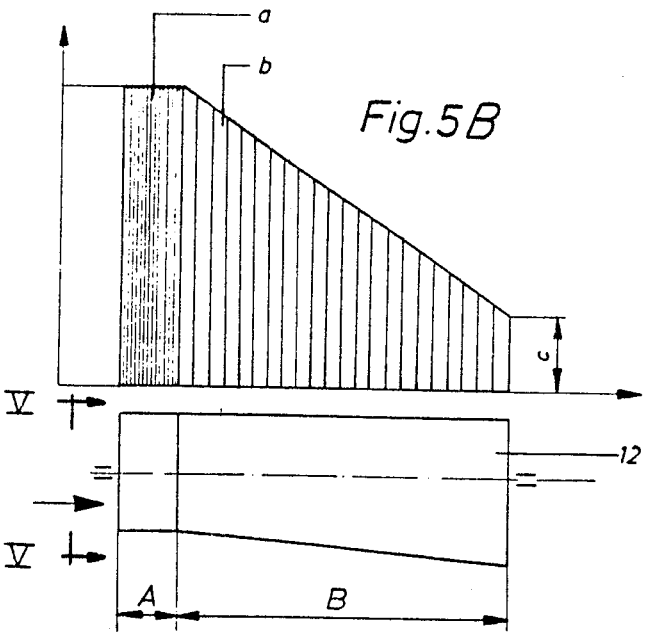
Fig.5B
Fig.5A
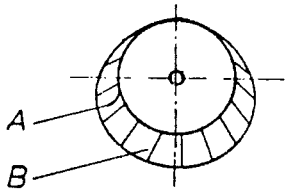
Fig.5
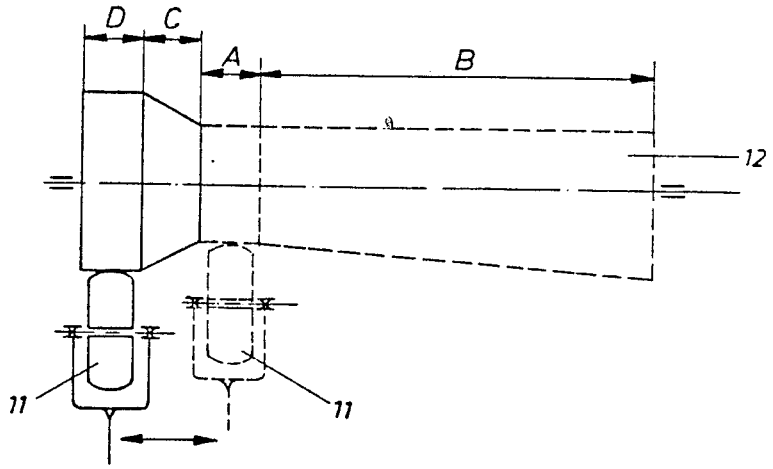
Fig.6

INK ROLLER

BACKGROUND OF THE INVENTION

This invention relates to an ink or form roller unit for an off-set rotary printing press. More particularly, the present invention relates to apparatus for the delivery of a fluid such as ink to such a printing press by either continuous or intermittent transfer from a fountain roller.

A basic distinction exists between film inker units and lifter inker units in ink or form roller units for an off-set rotary printing press. In a film form roller unit a continuous or continuing transfer of ink between an ink fountain roller and an inker unit located down stream therefrom. In lifter inkiers, the ink transfer is made intermittently by means of a lifter roller which oscillates or moves back and forth. Film inker units have the advantages that they work faster and can transfer more ink because of the continuous operation and they do not embody a design of oscillating elements. Lifter inkers, on the other hand, have the advantage of a more accurate metering of ink especially when transferring smaller amounts of ink.

A number of ink or form roller units already have been disclosed for changing from film to lifter operation and back in order to unite the advantages of both inker unit designs. The advantages of both types of inker units are equally valid for transferring materials other than ink. The inker or form roller units which can be changed from film to lifter operation and reversed are usually very complicated and constructed of many parts. Sometimes, changing from one mode of operation to another mode of operation is complicated and time consuming. Finally, with respect to known designs, of certain reversible ink-and-form roller units they have the disadvantage that one or several rollers are not used in one or the other modes of operation, i.e., such rollers are not used for ink transfer. A negative consequence rising out of the non-use of some of the rollers is that the non-used rollers must be cleaned thoroughly so they can be used when the mode of operation requiring their use is again selected because during an idle non-use period, the ink or other material which is on the rollers during the period of non-use dries. Even if the rollers are cleaned after the change in mode of operation, but before a start-up operation of the printing press while the ink or other material has not dried, there is still a rather substantial work factor, consumption of time and a standstill period of the complete press.

SUMMARY OF THE INVENTION

It is an object of the present invention to provide an inker or form roller unit which can be changed from film to lifter operation and avoid the disadvantages described hereinbefore of known designs of reversible inking and form roller units while at the same time, provide an inker or form roller unit which embodies a simple design and can be easily changed from one mode to another mode of operation even while the printing press is in operation with all rollers are being used in either mode of operation.

According to the present invention there is provided apparatus for delivering fluid in a printing press, the combination including reservoir means for the fluid, a fountain roller for carrying a film of fluid from the reservoir means, a combi-roller for receiving fluid from the fountain roller, a distribution roller to continuously receive fluid from the combi-roller for delivery to rollers of the printing press, means for selectively forming a continuous fluid transfer gap and an intermediate fluid transfer gap between the combi-roller and the fountain roller.

More specifically, according to the preferred apparatus of the present invention there is a continuously rotating combi-roller made of steel or other hard material which is selected in film operation to receive ink continuously from an ink fountain roller without contact therewith by forming a small gap which is adjustable by setting screws and by a control cam. The combi-roller constantly contacts a distribution roller consisting of rubber. The combi-roller moves with a pendulum motion in lifter operation with respect to the ink fountain roller while leaving open always a small gap therebetween which is adjustable by the setting screws and by the control cam while at the same time the combi-roller is kept in contact with the distribution roller even when the latter is moved away from the ink fountain roller so that the combi-roller and distribution roller remaining in, continuous contact. The ink blade front edge runs in a small gap from the ink fountain roller in both modes of operation.

In a further elaboration of the present invention, it is especially feasible to the realization of the idea of the invention to provide a design in which the combi-roller is supported by a swivel lever that can swivel about the center line or rotational axis of the distribution roller while the swivel lever is controlled by a cam roll supported on the lever with the cam roll on the swivel lever supported against a rotatably driven control body. The control body has a cylindrical section for film operation and adjacent to the cylindrical section there is a cam section having a cam shape which changes in the longitudinal direction thereof, the changing stroke of the cam is utilized by operating a setting mechanism that is infinitely adjustable in an axial direction for movement relative to the cam roll in either of opposite directions. By actual movement of the control body or of the cam roll, the inker or form roller unit can be changed from one mode of operation to the other. A change to the mode of inkier operation can be carried out while the press is operating. All rollers belonging to the inker unit are always in operation. The overall construction and design of the inker or form roller unit is quite simple.

The control body can be provided with a cone-shaped third section on the side of the cylindrical section which is opposite the cam section. The cone-shaped third section is normally used for film operation in order to change the amount of ink which is transferred. A shut-off device is effectively arranged to operate on a swivel lever and can be operated to keep the combi-roller constantly a distance away from the ink fountain roller order to completely shut off the operation of the inker unit.

The apparatus of the present invention embodies a design having the advantage of eliminating lifter impact, lifter noise and lifter streaks in the printed image which decreases wear on the lifter roller as well as the ink fountain roller and surrounding elements to a minimum. An important advantage of the present invention as compared to conventional ink or form roller units arises out of the fact that the present invention embodies a design wherein the ink blade and also ink fountain roller are substantially spared from wear because the ink blade does not touch the ink fountain roller in film operation or in lifter operation and, therefore, it is not necessary to rework or readjust these parts because of the effect of wear. This naturally leads to longevity of the ink blade.

These features and advantages of the present invention as well as others will be more fully understood when the following description is read in light of the accompanying drawings in which:

FIG. 3 is an end view of one embodiment of a control body taken along lines III—III of FIG. 3A for use in the apparatus of the present invention;

FIG. 3A is a front view of the control body shown in FIG. 3;

FIG. 3B is a graph in which the ordinate illustrates the inking which can be achieved with the individual parts of the control body as shown in FIGS. 3 and 3A;

FIG. 4 is an end view of a second embodiment of a control body taken along lines IV—IV of FIG. 4A for use in the apparatus of the present invention;

FIG. 4A is a front view of the control body shown in FIG. 4;

FIG. 4B is a graph in which the ordinate illustrates the inking which can be achieved with the individual parts of the control body as shown in FIGS. 4 and 4A;

FIG. 5 is an end view of a third embodiment of a control body taken along lines V—V of FIG. 5A for use in the apparatus of the present invention;

FIG. 5A is a front view of the control body shown in FIG. 5;

FIG. 5B is a graph in which the ordinate illustrates the inking which can be achieved with the individual ports of the control body shown in FIGS. 5 and 5A;

FIG. 6 is a view schematically illustrating a fourth embodiment of control body for completely shutting off the inker unit;

Figure 1:
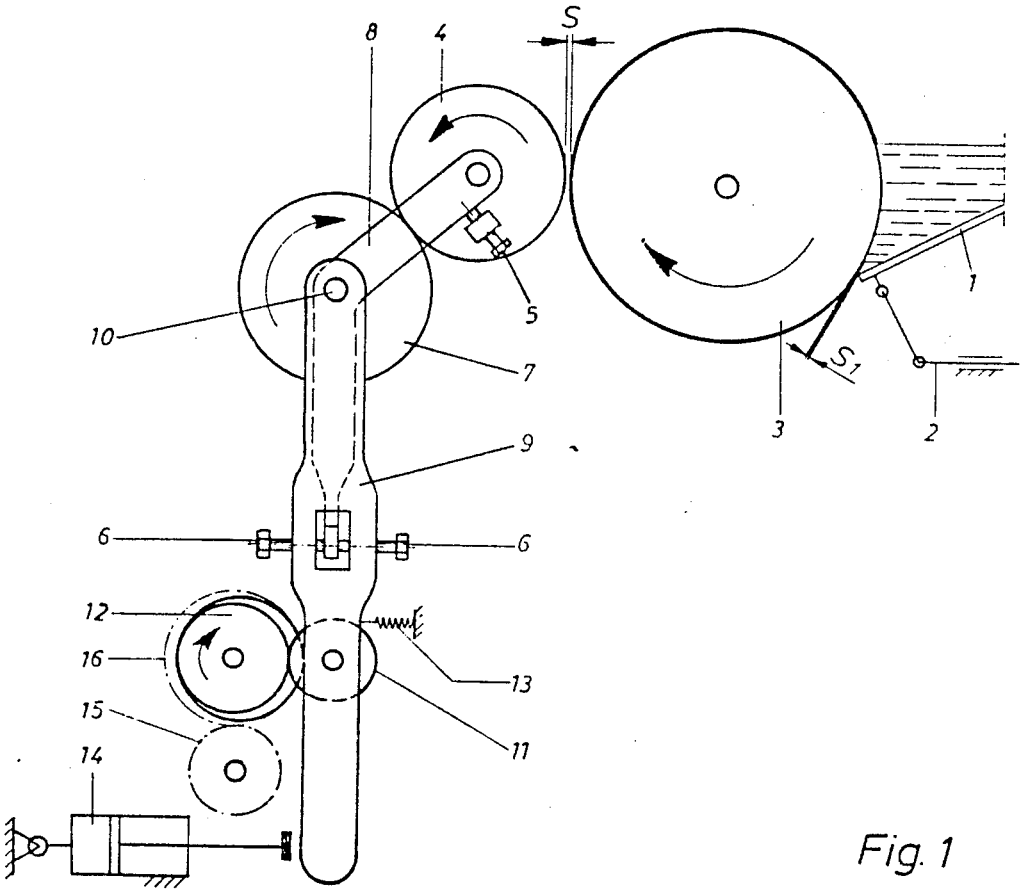
FIG. 1 illustrates, according to a first embodiment, a side view of parts of an inker and form roller unit which are adjacent to an ink fountain.

In the drawings, an arrow has been applied to rotating or rotatable parts to indicate the direction of rotation by these parts. Also, the same reference number has been applied in all figures of the drawings to a part which is the same or have the same effect or function. In FIG. 1, there is illustrated an ink fountain in which a reservoir of ink is contained above an ink blade 1 that is connected to an ink blade adjustment device 2. A steel ink fountain roller 3 sometimes called a ductor roller dips into the fountain. A gap S1 is formed between the roller and the blade 1 from which a film of ink is carried from the fountain on the surface of the roller. A combi-roller 4 cooperates with the ink fountain roller 3 for film i.e., a continuous inking mode of operation or lifter i.e., an intermittent or discontinuous mode of operation. The combi-roller 4 is also made of steel or other hard material. A gap S is always maintained between the ink fountain roller 3 and the combi-roller 4 so that there is never direct contact between these two rollers. The size of the gap S can be adjusted by the operation of setting screws 5 and 6 and a control cam 12. When the gap S1 between ink blade 1 and the ink fountain roller 3 is set, for example, to a value of 0.060 mm, then the ink fountain roller picks up a uniformly thick ink film which also serves as lubrication of the ink blade 1. The gap S will be set in this example to a dimension of 0.080 mm. In this way, a gap of 0.020 mm remains between the ink film on the ink fountain roller 3 and the combi-roller 4 which is lessened by the ink film layer returned by the combi-roller 4. From the combi-roller 4, the ink is transferred to a vibrating rubber roller 7 which is in constant contact with the combi-roller 4.

The combi-roller is supported, in the example illustrated in FIG. 1, by a swivel lever comprised of two parts 8 and 9. Setting screws 6 effectively adjust the position of the two parts 8 and 9 of the swivel lever so that when adjustment is completed the swivel lever functions as a single part. The swivel lever, and at the same time its two parts which are positioned in relation to each other can be swiveled and are supported for pivotal movement about the center line 10, i.e., rotational axis, of distributing roller 7. The swivel lever carriers a cam roll 11 which cooperates with a control body identified by reference numeral 12. The cam roll 11 is kept constantly in contact with the control body 12 by a compression spring 13. Contact between the cam roll and control body can, of course, also be achieved by a tension spring arranged in a correspondingly different manner without departing from the spirit of the present invention.

A shut-off device 14 shown schematically, can be operated in any suitable way or manner, e.g., hydraulically, pneumatically, electro-magnetically etc. The shut-off device 14 operates on the bottom end of a swivel lever comprised of parts 8 and 9 to swivel the entire lever about its swivel point 10 in a counter-clockwise direction, as one views FIG. 1, i.e., in a direction toward the right side of the illustration. Movement of the lever by the shut-off device consequently moves the cam roll 11 away from the control body 12 whereby the swivel lever stops swinging movement and at the same time, the combi-roller 4 is moved away from the ink fountain roller 3 to such an extent that the inkier or form roller unit will be completely shut off.

Figure 2:
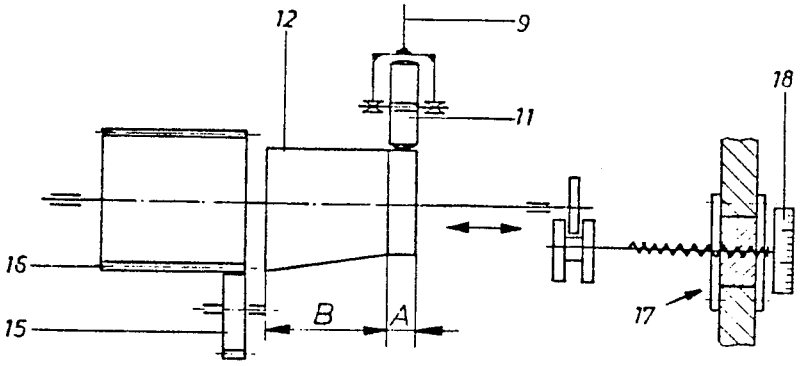
FIG. 2 is a front view of the parts shown in the lower portion of the illustration in FIG. 1.

The control body 12 is driven through a drive that includes two gears 15 and 16 which are shown in the illustrated embodiment of FIGS. 1 and 2. The control body 12 is driven to turn proportionately to the complete printing unit or inker/form unit drive. In FIG. 2, the control body has a cylindrical Section A for film operation and adjacent thereto is a cam Section B for lifter operation. The cam section has a cam form which changes in a longitudinal direction along Section B which is parallel to the rotational axis for metering the amount of ink that is supplied during lifter operation. Cam Section B can be of any suitable configuration with changing eccentricity in the length direction. The complete control body 12 can be moved against the cam roll 11 or vise versa in an axial direction in order to change from film operation to lifter operation and vice versa. At the same time, it is possible to change the amount of ink which is transferred during lifter operation. The setting mechanism provided for this purpose is identified by reference numeral 17, the details of which need not be explained because the mechanism can be of any suitable type. It is desirable to provide the setting mechanism 17 with a display dial 18 to display the setting which is made. The display dial firstly enables one to recognize the operation mode as an inker or form roller unit and secondly, to reproduce set values once found favorable during lifter operation. Greater details of the control body 12 used in the embodiment of FIGS. 1 and 2 as well as inking which can be achieved by the use of the control body are shown in FIGS. 3, 3A and 3B of the drawings.

When the apparatus is operated as a film inker, the cam roll 11 contacts the cylindrical section A of the control body 12 which is centric with the axis of rotation as shown in FIGS. 1 and 2. The combi-roller 4 remains in a stationary position except, of course, for continuous rotation of the roller. The ink blade 1 is adjusted from its basic position by means of individual elements of the ink blade adjusting device 2, e.g., zone screws or keys, to adapt the inking to the subject to be printed. This ink relief, which is located above the 0.080 mm thick smear or grease ink film specified in the example given hereinbefore, is taken along by the combi-roller 4 and transferred to the remaining inker. However, only a portion of the ink amount is transported and the portion remains on the combi-roller which carries it back to the gap S1. At gap S1, a new constant ink relief is formed which is in balance with the ink flow. The amount of ink is metered out on the one hand with a speed or revolution control and, on the other hand, with the adjustment of the ink blade 1 by means of the ink blade adjusting device 2.

The inker is used as a lifter inker for web offset rotary presses, i.e., switched to a lifter ink mode, when continuous inking is still too much despite a minimum setting for the metering of ink. A change to the mode of operation is made by axial relative movement between the control body 12 and cam roll 11 through operation of the setting mechanism 17 as explained previously so that the cam roll 11 now contacts cam Section B of the control body 12. In this mode of operation, the amount of transported ink can be metered from a maximum to zero by means of the infinitely variable size to the stroke, pendulum movement, of the combi-roller 4. The ink blade 1 and the revolution or speed of the ink fountain roller 3 do not have to be adjusted. When set for zero metering, the combi-roller 4 does not supply any ink because the combi-roller does not touch the ink relief gap with the fountain roller 3. In this way, the effect of the combi-roller 4 and consequently the ink supply to the subsequent inker or form roller train is turned off.

When using the apparatus of the present invention as a pure lifter inker, the stop time of the combi-roller 4 at the ink fountain roller 3 can be varied by the form of the cam Section B of the control body 12. In any random adjustment of this kind, the combi-roller 4 is constantly in contact with the subsequently arranged distribution roller 7 because the swivel axis of the swivel levers 8 and 9 coincide with the rotational axis of the distribution roller 7. There are possibilities available according to the apparatus of the present invention to meter the amount of ink for lifter or film working modes first by the speed or revolution control of the ink fountain roller 3, secondly, by adjustment of the ink blade 1, and thirdly, by modifying the cam Section B or varying the setting of the cam roll 11 along Section B of the control body 12.

The control body 12 shown in FIGS. 1 and 2 is illustrated in greater detail in FIGS. 3, 3A, and 3B. From FIGS. 3 and 3A it can be seen that Section A of the control body 12 is cylindrical and Section B is a cam section. The eccentricity of the cam section becomes larger and larger progressively at the end thereof which is opposite Section A. The cam is formed as a circular eccentric with a continuously larger crown height. A zero-metering of ink, i.e., a complete shut off of the inker or the form rollers, is carried out by operation of shut off device 14. As shown in FIG. 3B, the inking which can be achieved by the individual sections of the control body 12 are shown along the ordinate of the graph with the abscissa being the face length of Sections A and B. Zone (a) is the film mode of operation by the inker carried out by the use of section A of the control body. Zone (b) is a metering range in a lifter mode of operation using Section B of the control body. Abscissa height (c) indicates a remainder film of inking in the lifter mode.

In FIGS. 4 and 4A, the control body again comprises Sections A and B in which Section A is essentially the same as described previously in connection with FIGS. 3, 3A and 3B. Section B is a lifter cam section wherein by progressing along the length of this section there is a rough-to-fine-to-zero metering of ink. The lifter cam Section B forms a cam with two differently formed cones to achieve a zero metering of ink. Zero metering can be made in this instances without the use of a shut-off device 14.

In FIGS. 5 and 5A, the control body 12 is again made up of a Section A wherein inking is carried out for film operation and Section B in which inking is controlled as shown by Zone (b) of FIG. 5B by a rough-to-fine metering. Zero-metering is controlled by the shut-off device 14 for the combi-roller 4. The cam forming Section B has a one-sided cone shape.

In FIG. 6, the control body 12 also has a one-sided conical control cam forming Section B for the lifter range and cylindrical Section A for film operation. The control body is designed to provide the additional feature of a shut-off for the inker or forming roll train without the operation of a separate control such as shut off device 14. As shown in FIG. 6, Section B extends from one side of Section A and from the other side of Section A there is a transition Section C which extends to a Section D which is a section when engaged with cam roll 11 that effects shut off of the inker or form roller train. Section C is a transition section which facilitate movement of cam roll from Section A to Section D.

Figure 7:
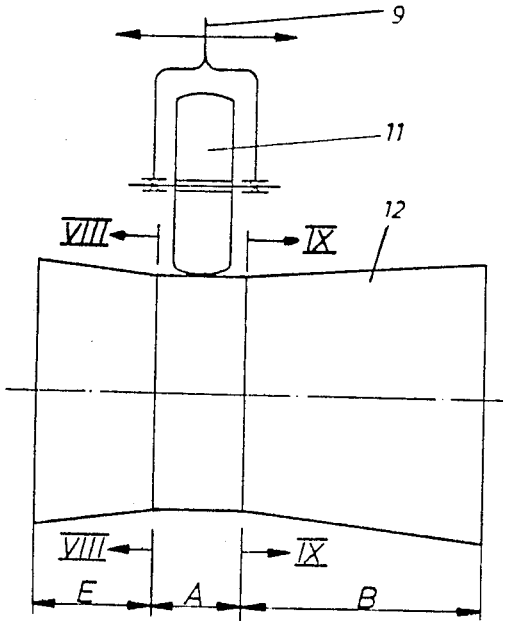
FIG. 7 is a view similar to FIGS. 3, 4, 5 and 6 and illustrating a fifth embodiment of a control body.
Figure 8:
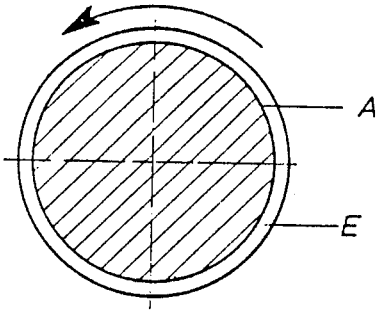
FIG. 8 is a sectional view taken along lines VIII—VIII of FIG. 7.
Figure 9:
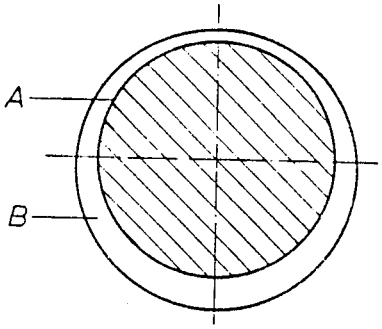
FIG. 9 is a sectional view taken along IX—IX of FIG. 7.
Figure 10:
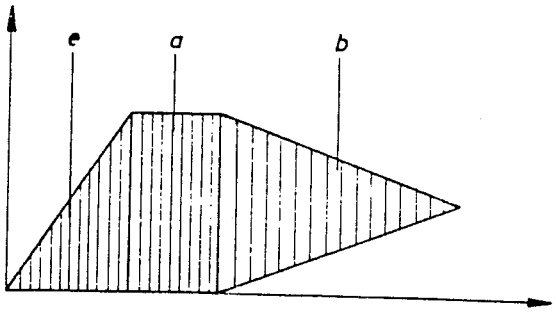
FIG. 10 is graph similar to FIGS. 3B, 4B and 5B illustrating inking achieved with the control body shown in FIG. 7.

In FIG. 7, there is illustrated a design of a control body which is similar to the control body shown in FIG. 4 cylindrical Section A of the control body in FIG. 7 establishes an inking film having a thickness which is identified by reference (a) in FIG. 10 which shows a constant zone for the ink film range. A double cone-shaped Section B forms a non-continuous or intermittent metering range for the lifter operation and Section E is a continuous inking film metering section which provides for the ink metering in film operation. Section E extends from the side of Section A which is opposite to Section B. The continuous film ink metering Section E can be seen by the co-axial relation of the cam forming Section E and Section A from FIG. 8 and in FIG. 9. The eccentric relation of the cam forming Section B is shown in relation to Section A.

Although the invention has been shown in connection with a certain specific embodiment, it will be readily apparent to those skilled in the art that various changed in form and arrangement of parts may be made to suit requirements without departing from the spirit and scope of the invention.

I claim as my invention:

1. Apparatus for delivering fluid in a printing press, the combination including reservoir means for fluid, a fountain roller for carrying a film of fluid from said reservoir means, a combi-roller for receiving fluid from said fountain roller, a distribution roller to continuously receive fluid from said combi-roller for delivery to rollers of a printing press, and means for adjusting the relative position of the peripheral surface of said combi-roller with respect to the peripheral surface of said fountain roller to selectively locate said peripheral surfaces in a constant spaced relationship to provide continuous fluid transfer gap therebetween and in a variable spaced relationship to provide an intermittent fluid transfer gap therebetween.

2. The apparatus according to claim 1 wherein said means for adjusting include a cam for controlling movement of said combi-roller toward and away from said fountain roller.

3. The apparatus according to claim 1 further including means to position said combi-roller while in contact with said distribution roller for adjusting the width of said continuous fluid transfer gap.

4. The apparatus according to claim 1 wherein said means for selectively forming include a drive to impart pendulum motion to said combi-roller to form said intermittent fluid transfer gap.

5. The apparatus according to claim 1 further including a swivel lever supported to pivot about a rotational axis of said distribution roller.

6. The apparatus according to claim 5 wherein said means for adjusting include a cam roll supported by said swivel lever, and a driven control body supported about a rotational axis including a cylindrical first section for establishing said continuous fluid transfer gap and a cam second section with a longitudinally extending cam surface for establishing said intermittent fluid transfer gap.

7. The apparatus according to claim 6 further including means for adjusting the longitudinal position of said cam roll along said control body.

8. The apparatus according to claim 7 wherein said means for adjusting the longitudinal position include a setting mechanism to infinitely adjust the position of said cam roll in a direction of the rotational axis of said driven control body.

9. The apparatus according to claim 7 wherein said setting mechanism is connected to said driven control body for movement in a direction of the rotational axis.

10. The apparatus according to claim 9 wherein said driven control body further includes a cone shaped third section for changing the amount of fluid transferred at said intermittent fluid transfer gap.

11. The apparatus according to claim 10 wherein said cone shaped third section extends from a side of said cylindrical first section which is opposite said cam second section.

12. The apparatus according to claim 6 further including means engaged with said swivel lever to move said combi-roller in a direction away from said fountain roller for stopping fluid transfer therebetween.

* * * * *